US007246564B2

(12) United States Patent
Chuo

(10) Patent No.: US 7,246,564 B2
(45) Date of Patent: Jul. 24, 2007

(54) DIFFERENTIAL FEEDING MECHANISM OF THE FRONT AND REAR TRANSLATION GEARS OF A TRANSVERSE SHUTTLE-TYPE SEWING MACHINE

(75) Inventor: Jui-Jung Chuo, Taipei Hsien (TW)

(73) Assignee: Shing Ray Sewing Machine Co., Ltd., Taipei Hsien (TW)

( * ) Notice: Subject to any disclaimer, the term of this patent is extended or adjusted under 35 U.S.C. 154(b) by 169 days.

(21) Appl. No.: 11/198,318

(22) Filed: Aug. 8, 2005

(65) Prior Publication Data

US 2007/0028820 A1 Feb. 8, 2007

(51) Int. Cl.
*D05B 27/08* (2006.01)
*D05B 35/00* (2006.01)

(52) U.S. Cl. ..... 112/313

(58) Field of Classification Search ..... 112/47, 112/324, 323, 312, 313, 314, 319
See application file for complete search history.

(56) References Cited

U.S. PATENT DOCUMENTS 3,202,121 A * 8/1965 Orth et al. ..... 112/313
3,368,507 A * 2/1968 Orth ..... 112/311
3,382,827 A * 5/1968 Von Hagen ..... 112/313
3,416,473 A * 12/1968 Peterson et al. ..... 112/313
3,611,817 A * 10/1971 Smith et al. ..... 112/313
4,412,498 A * 11/1983 Scholl ..... 112/313

FOREIGN PATENT DOCUMENTS

TW 541377 7/2003

* cited by examiner

*Primary Examiner*—Ismael Izaguirre
(74) *Attorney, Agent, or Firm*—Birch, Stewart, Kolasch, & Birch, LLP.

(57) ABSTRACT

A differential feeding mechanism of the front and rear translation gears of a transverse shuttle-type sewing machine can adjust the fabric feeding speeds of the front and rear translation gears. A main shaft coupled to the power source of the sewing machine is used to drive a front and a rear rocking shafts parallel to but not coaxial with the main shaft to swing up and down, which further drives the front and rear translation gears to feed fabric in. The front and rear rocking shafts are separately pivotedly coupled to front and rear swing arms to form a swing unit. Counter balance weights are pivotedly installed to the swing unit. Shift elements are pivotedly installed to the counter balance weights, which can control the ranges of the planar to-and fro travels of the front and rear translation gears and creates different effects of the sewing thread.

6 Claims, 15 Drawing Sheets

DIFFERENTIAL FEEDING MECHANISM OF THE FRONT AND REAR TRANSLATION GEARS OF A TRANSVERSE SHUTTLE-TYPE SEWING MACHINE

FIELD OF THE INVENTION

The present invention relates to a transverse shuttle-type sewing machine, particularly to a transverse shuttle-type sewing machine, wherein the feeding travels of the front and rear translation gears can be separately adjusted.

BACKGROUND OF THE INVENTION

With advance of science and technology and maturity of fabric industry, various new fabrics having the quality distinct from that of the traditional fabrics, have been developed. Further, with economic promotion, people pay more attention to dressing and pursue style. Therefore, to meet diversified dressing designs, sewing method has to advance further.

In earlier times, the translation gear of a single-translation-gear sewing machine was only to feed fabric into the sewing position. Under constant rotation speed of the motor, if the number of the needle reciprocation was also constant, changing the sewing thread pitch would be achieved via only changing the travel range of the translation gear, which determines the fabric feeding quantity. However, confronting current new-type fabrics (such as an elastic fabric) and various dressing designs (such as a dress with wrinkles intentionally formed on the sewing thread), the above mentioned single-translation-gear sewing machine cannot satisfy the demand obviously. Therefore, double-translation-gear sewing machine is adopted in most cases nowadays. The function of the rear translation gear thereof is equivalent to the above mentioned single translation gear, and the sewing thread pitch can be adjusted via changing the travel range of the rear translation gear. The function of the front translation gear is to determine the ratio between the delivered-out fabric amount and the feed-in fabric amount to form different patterns of the fabric neighboring the sewing thread, such as plane, tension or wrinkled pattern, i.e. so-called differential ratio, via that the front translation gear translates the fabric in speed equal to, higher or less than the feeding speed of the rear translation gear. Thus, the double-translation-gear sewing machine can meet the demand of current elastic fabrics and diversified dressing designs.

Nevertheless, none of the current transverse shuttle-type sewing machines can separately adjust the travel ranges of the front and rear translation gears, i.e. the sewing thread pitch and the differential ratio, for example, a R.O.C. Patent Publication No. 541377 of the inventor, entitled "Sewing Machine with an Adjust Mechanism of the Front Differential Feeding", which uses an adjust mechanism of the front differential feeding to adjust the speed of the front translation gear and comprises: a swing element, four linking-up elements, an adjust mechanism, and a transmission shaft. In this patent, the adjust mechanism of the front differential feeding is actuated by the transmission mechanism of the rear differential feeding and drives the front translation gear to move to and fro. The adjust mechanism of the front differential feeding has an adjust mechanism, which can change the ranges of the planar to-and-fro feeding travel of the front translation gear. When the user shifts the adjust mechanism during operation, he can modify the travel range of the front translation gear. Although the travel range of the front translation gear can be adjusted in this invention, the travel range of the rear translation gear cannot be adjusted but is determined by the front translation gear. Therefore, the travel ranges of the front and rear translation gears cannot be separately adjusted. Thus, the sewing thread pitch and the differential ratio cannot be adjusted separately and arbitrarily as the user demands. Accordingly, it is a problem the sewing machine manufacturers desire to solve to provide a sewing machine wherein the user can arbitrarily and separately adjust the sewing thread pitch and the differential ratio to meet the cases that a special fabric is used, special sewing thread pitch is needed or wrinkles are demanded.

SUMMARY OF THE INVENTION

The primary objective of the present invention is to provide a differential feeding mechanism of the front and rear translation gears of a transverse shuttle-type sewing machine.

To achieve the above mentioned objective, the differential feeding mechanism of the front and rear translation gears of a transverse shuttle-type sewing machine according to the present invention comprises: two rocking shafts, used to drive the front and rear translation gears, which feed in or deliver out fabric; a swing unit, pivotedly installed to the rocking shafts to form the feeding travels of the front and rear translation gears; and adjust units, separately to the rocking units, and used to control the ranges of the to-and fro transverse travels of the front and rear translation gears; wherein the user can control different adjust units separately linked to the front and rear translation gears to obtain the best ranges of the to-and fro transverse travels of the front and rear translation gears for different fabrics and different sewing designs, i.e. control the pitch of a sewing thread and the differential ratio of the front and rear translation gears.

DETAILED DESCRIPTION OF THE PREFERRED EMBODIMENTS

The detailed description and the technical contents of the present invention are to be stated below in cooperation with the attached drawings.

Figure 1:
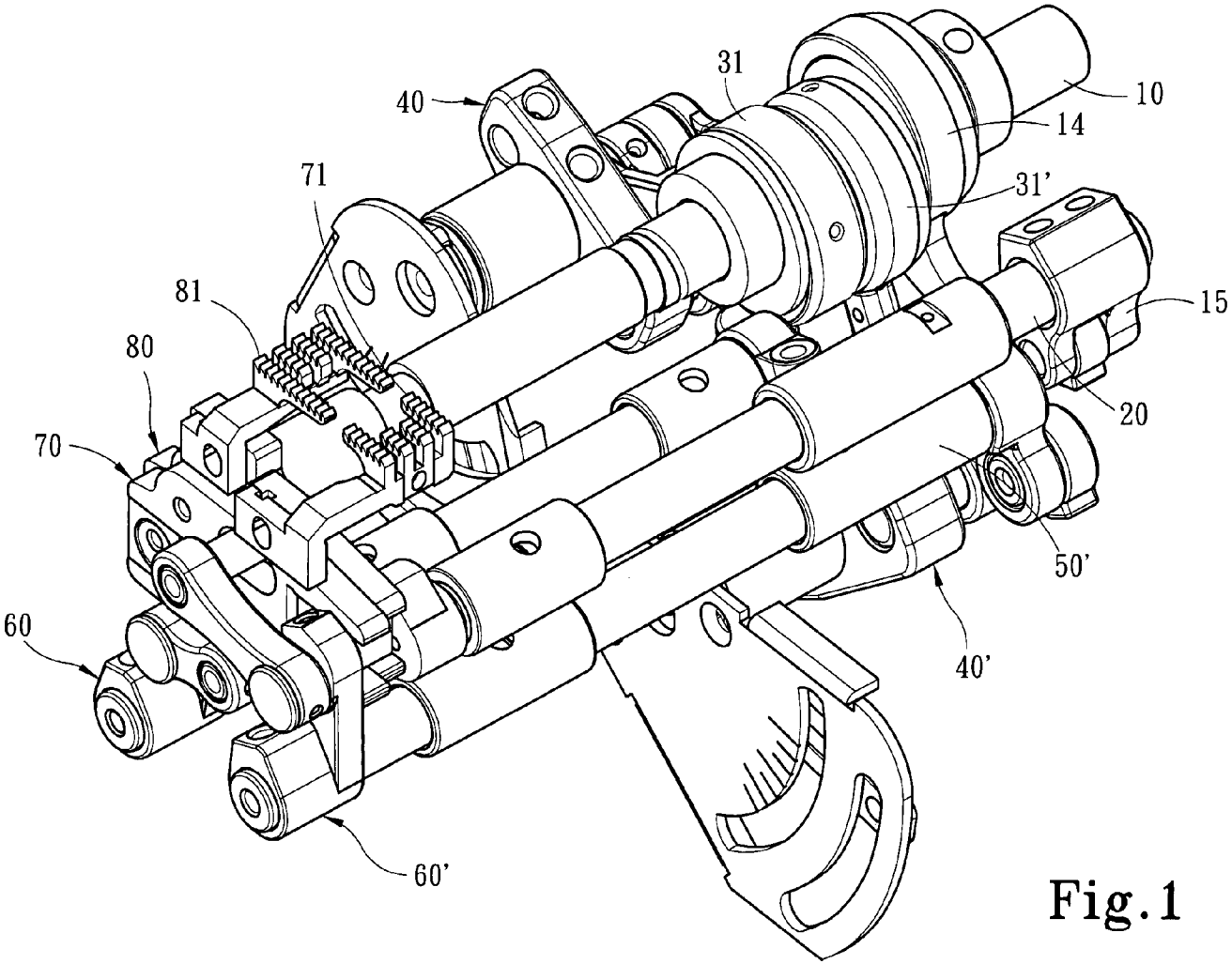
FIG. 1 is a perspective view schematically showing the appearance of the present invention.
Figure 2A:
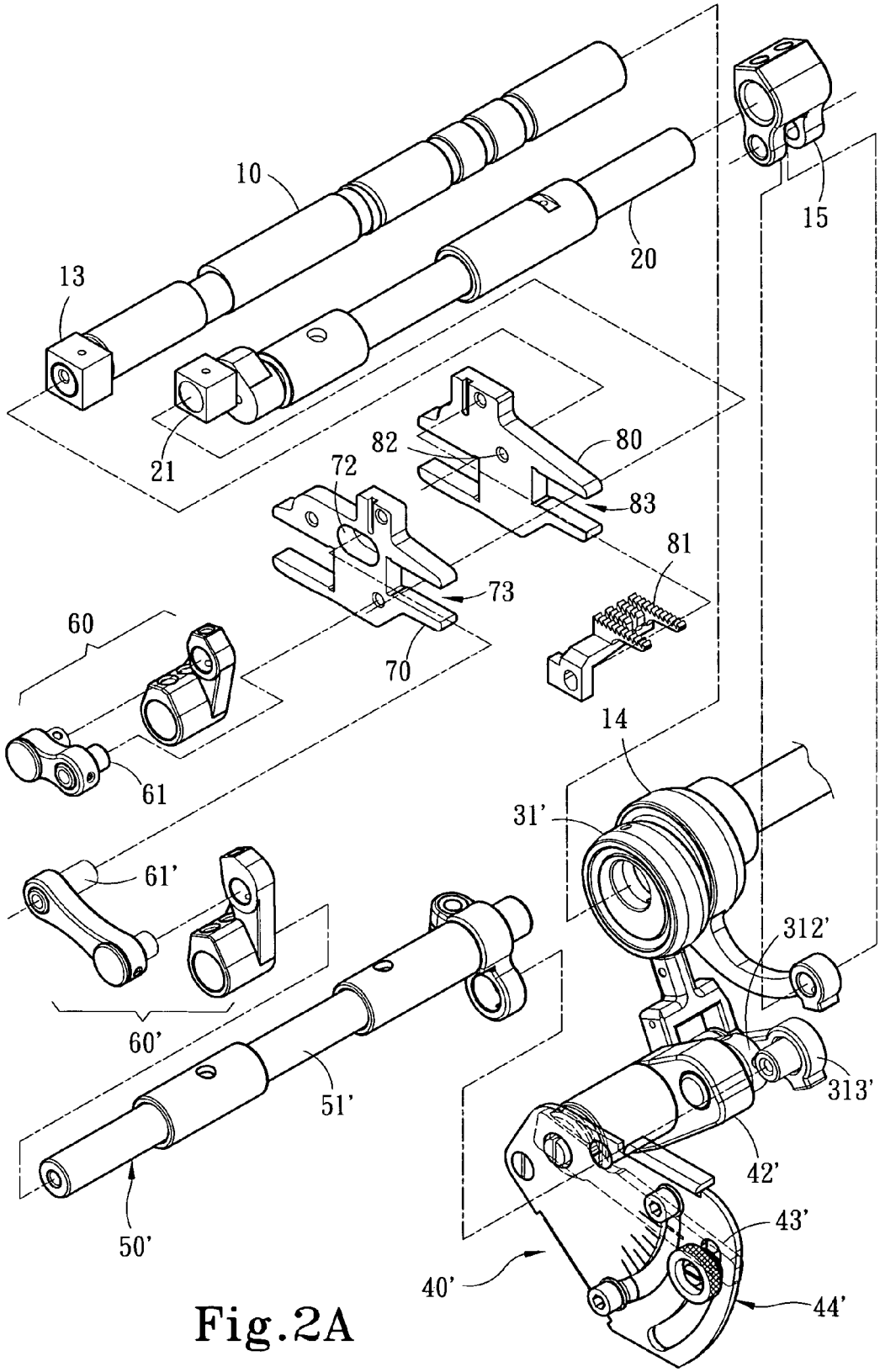
FIG. 2A and FIG. 2B are exploded views schematically showing the structure of the present invention.
Figure 2B:
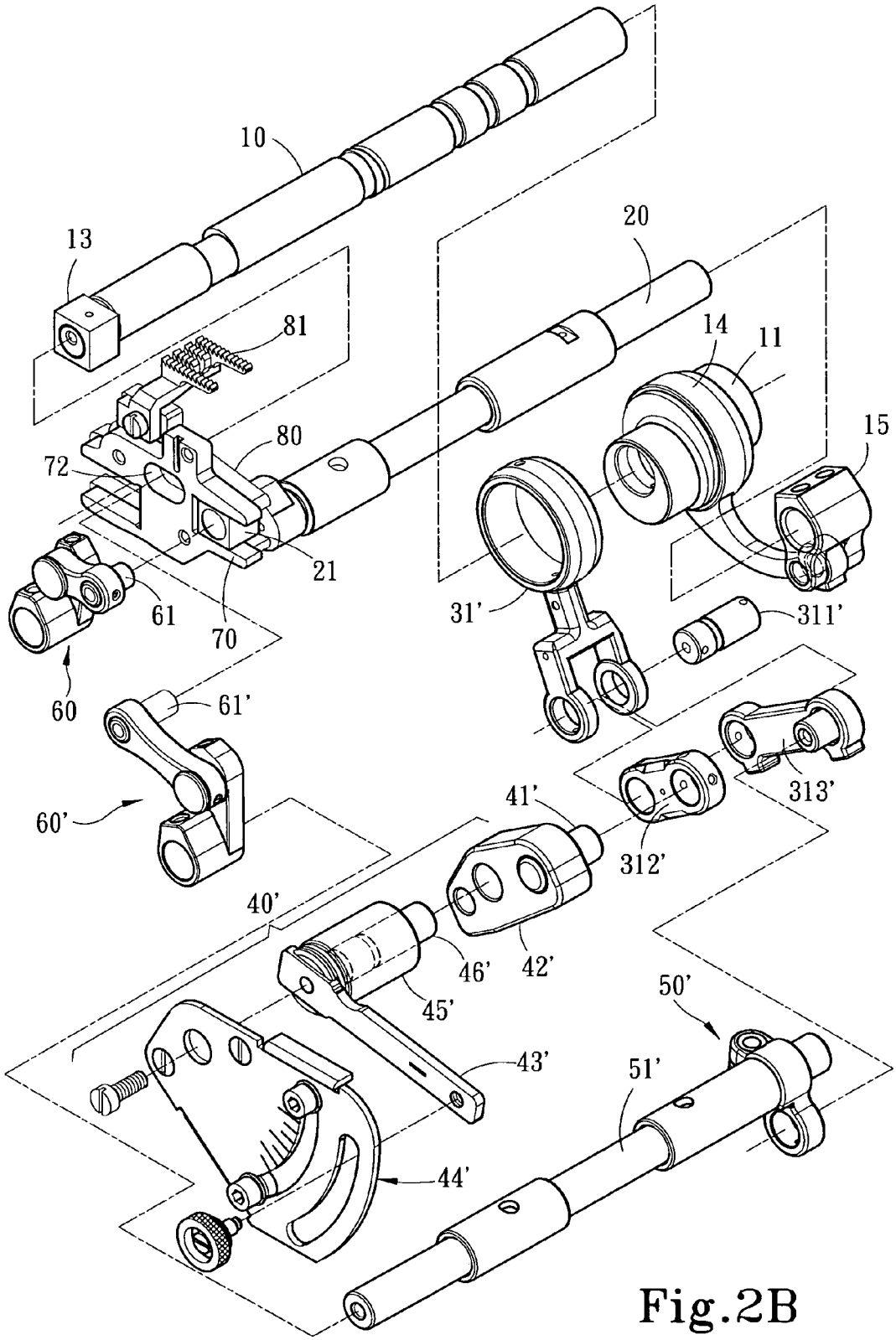
Figure 2C:
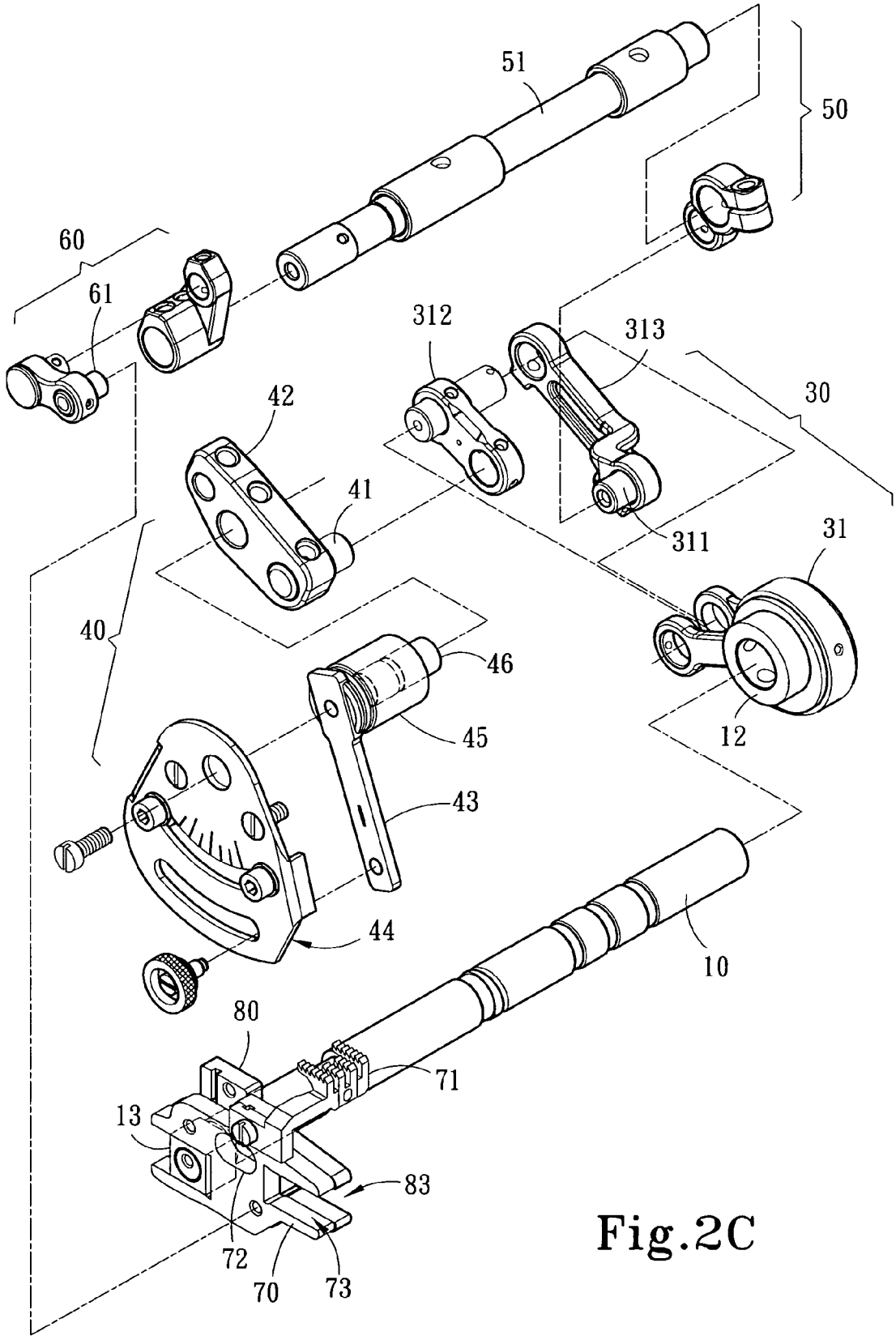
FIG. 2C and FIG. 2D are schematic diagrams showing the assembly of partial structure of the present invention.
Figure 2D:
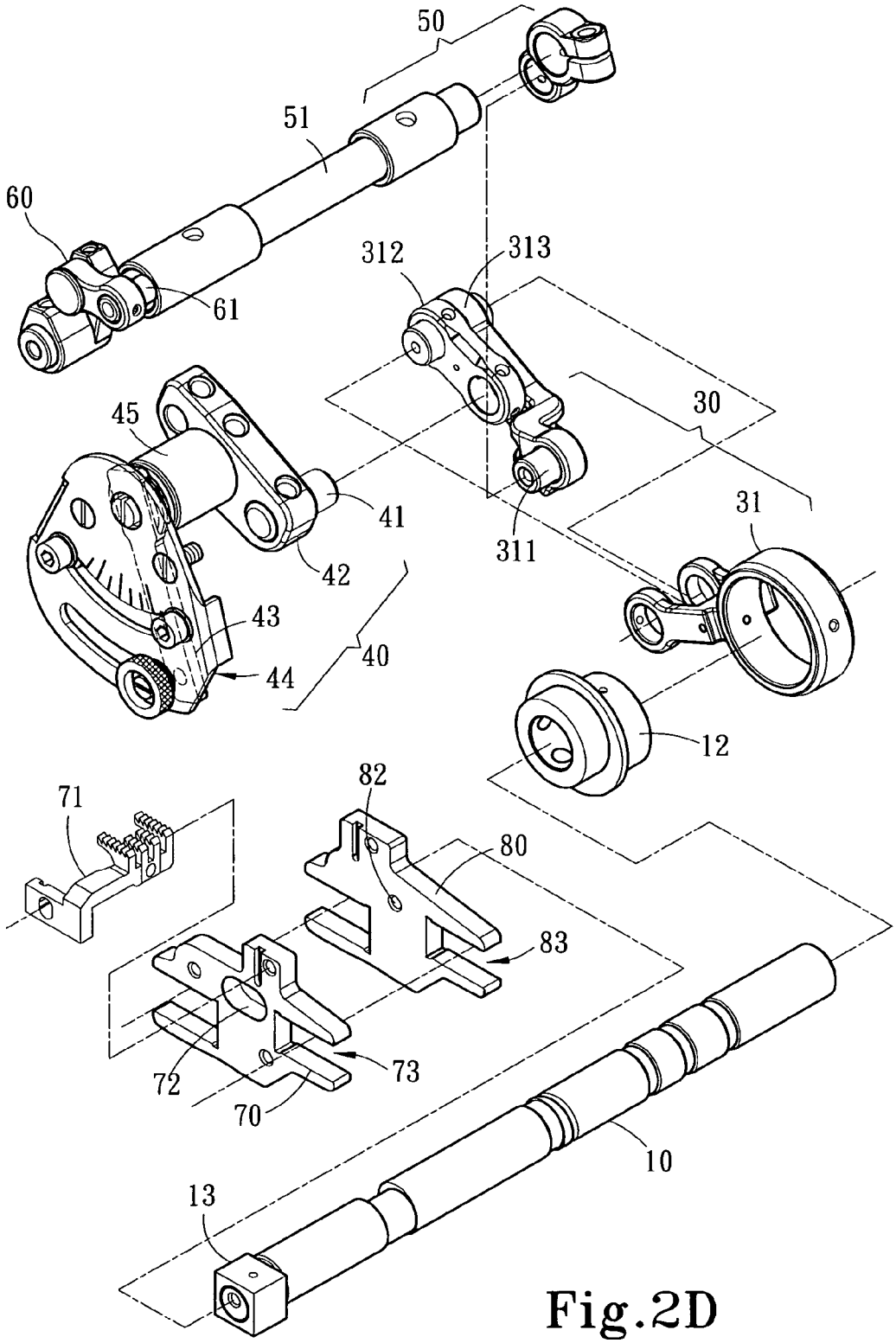

Refer to FIG. 1, FIG. 2A and FIG. 2B separately the perspective view and exploded views schematically showing the present invention. The present invention is a differential feeding mechanism 2 of the front and rear translation gears of a transverse shuttle-type sewing machine 1. A main shaft 3 coupled to the power source of the transverse shuttle-type sewing machine 1 is pivotedly coupled to and drive a front rocking shaft 10 parallel to but not coaxial with the main shaft 3. The front rocking shaft 10 is driven to swing up and down by the main shaft 3. A first eccentric sleeve 11 and a second sleeve 12 are coupled to the front rocking shaft 10. A link arm 14 is pivotedly installed to one end of the first eccentric sleeve 11. A crank 15, which is coupled to a rear rocking shaft 20, is pivotedly installed to the other end of the link arm 14 in order to drive the rear rocking shaft 20 to swing up and down. A swing unit 30, which has a front swing arm 31 and rear swing arm 31', is coupled to the other end of the first eccentric sleeve 11 and one end of the second eccentric sleeve 12. One end of the front swing arm 31 is coupled to the second eccentric sleeve 12, and the rear swing arm 31' is coupled to the other of the first eccentric sleeve 11. Via shafts 311, 311', the other ends of the front and rear swing arms 31, 31' are separately pivotedly coupled to the ends of first connecting levels 312, 312' and second connecting levels 313, 313'. The other ends of the firs connecting arms 312, 312' are pivotedly coupled to adjust units 40, 40'. Refer to FIG. 2C and FIG. 2D. The adjust units 40, 40' further comprise: counter balance weights 42, 42', coupled to the first connecting levels 312, 312' via shafts 41, 41'; shift elements 43, 43', installed to the counter balance weights 42, 42' via rotation elements 46, 46' that are inserted through sleeves 45,45', wherein the shift elements 43, 43' are used to displace the counter balance weights 42, 42'; and scale elements 44, 44', used to indicate the positions of the counter balance weights 42, 42'. The other ends of second connecting levels 313, 313' are separately pivotedly coupled to the ends of fixed transmission shafts 51, 51' of transmission arm units 50, 50'. The other ends of the transmission shafts 51, 51' are coupled to displacement arm units 60, 60'. Positioning elements 61, 61' of the displacement arm units 60, 60' are inserted position-limiting holes 72, 82 of front and rear translation blocks 70, 80 having front and rear translation gears 71, 81, which create the to-and-fro feeding actions of the front and rear translation gears 71, 81. The sides of the front and rear translation blocks 70, 80 have concave portions 73, 83. Convex portions 13, 22 at the ends of the front and rear rocking shafts 10, 20 and eccentric to the central axes thereof are engaged with the concave portions 73, 83 of the front and rear translation blocks 70, 80 in order to create the up-and-down swing actions of the front and rear translation gears 71, 81.

Figure 3A:
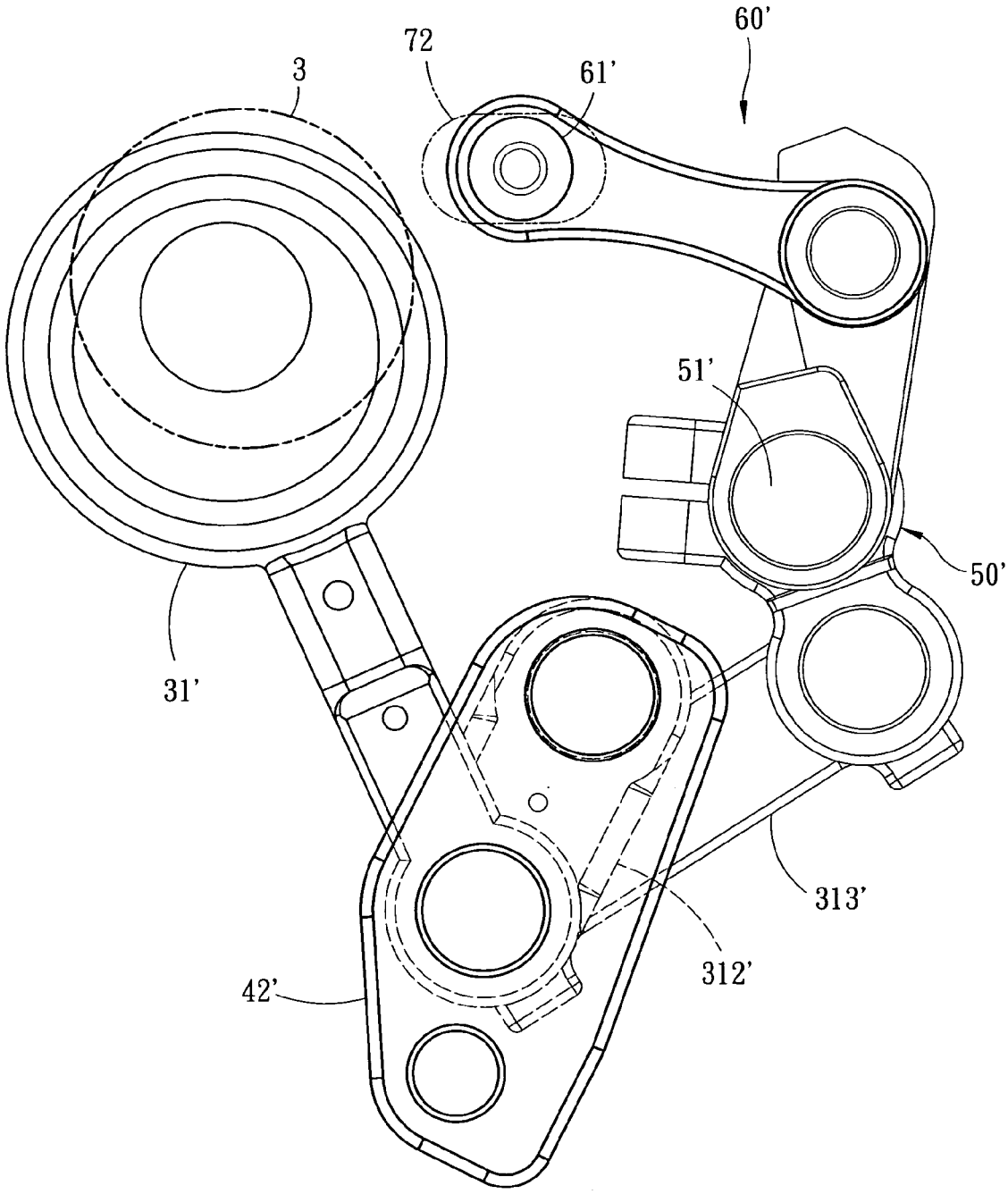
FIG. 3A, FIG. 3B and FIG. 3C are schematic diagrams showing the operations of one embodiment of the present invention.
Figure 3B:
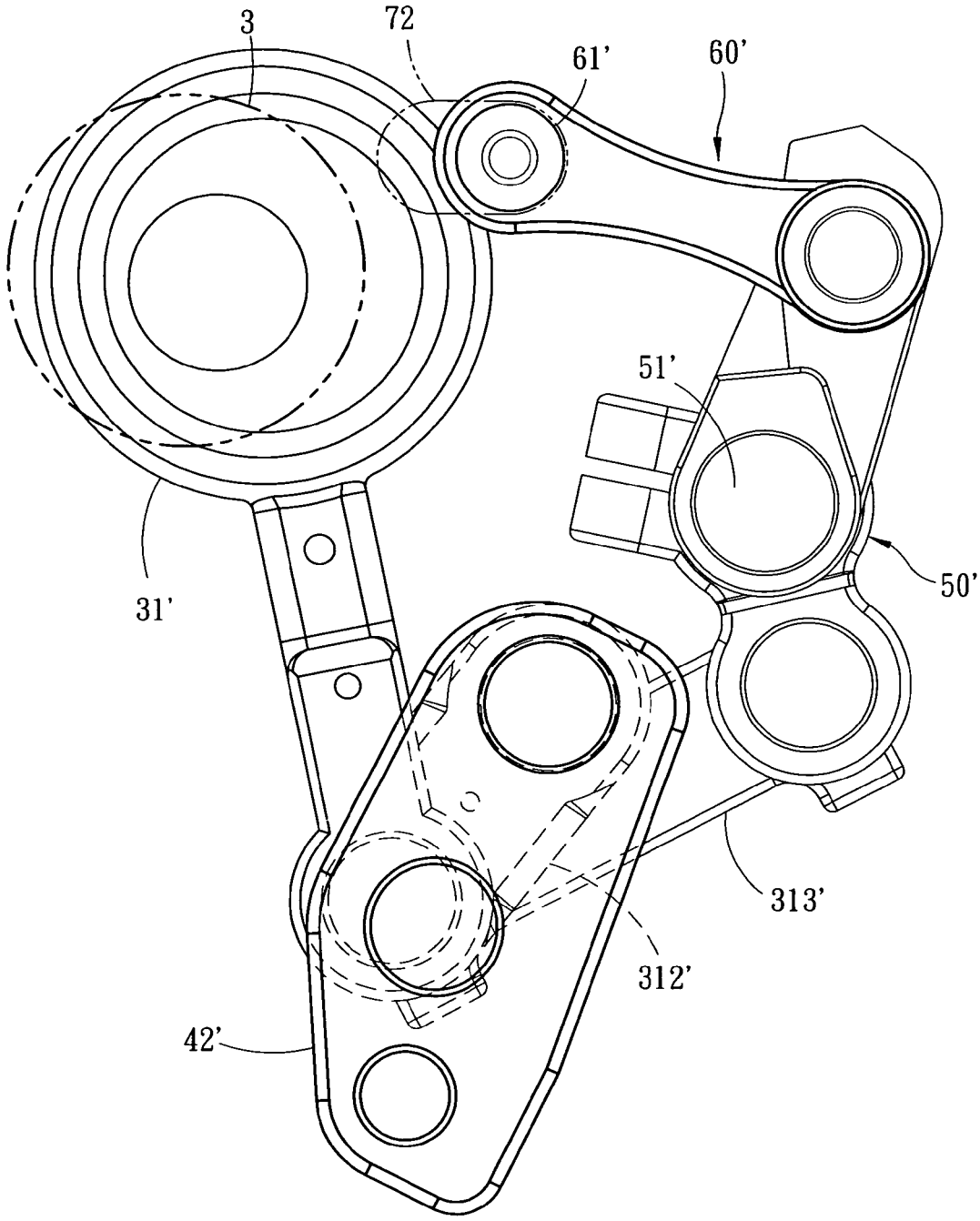
Figure 3C:
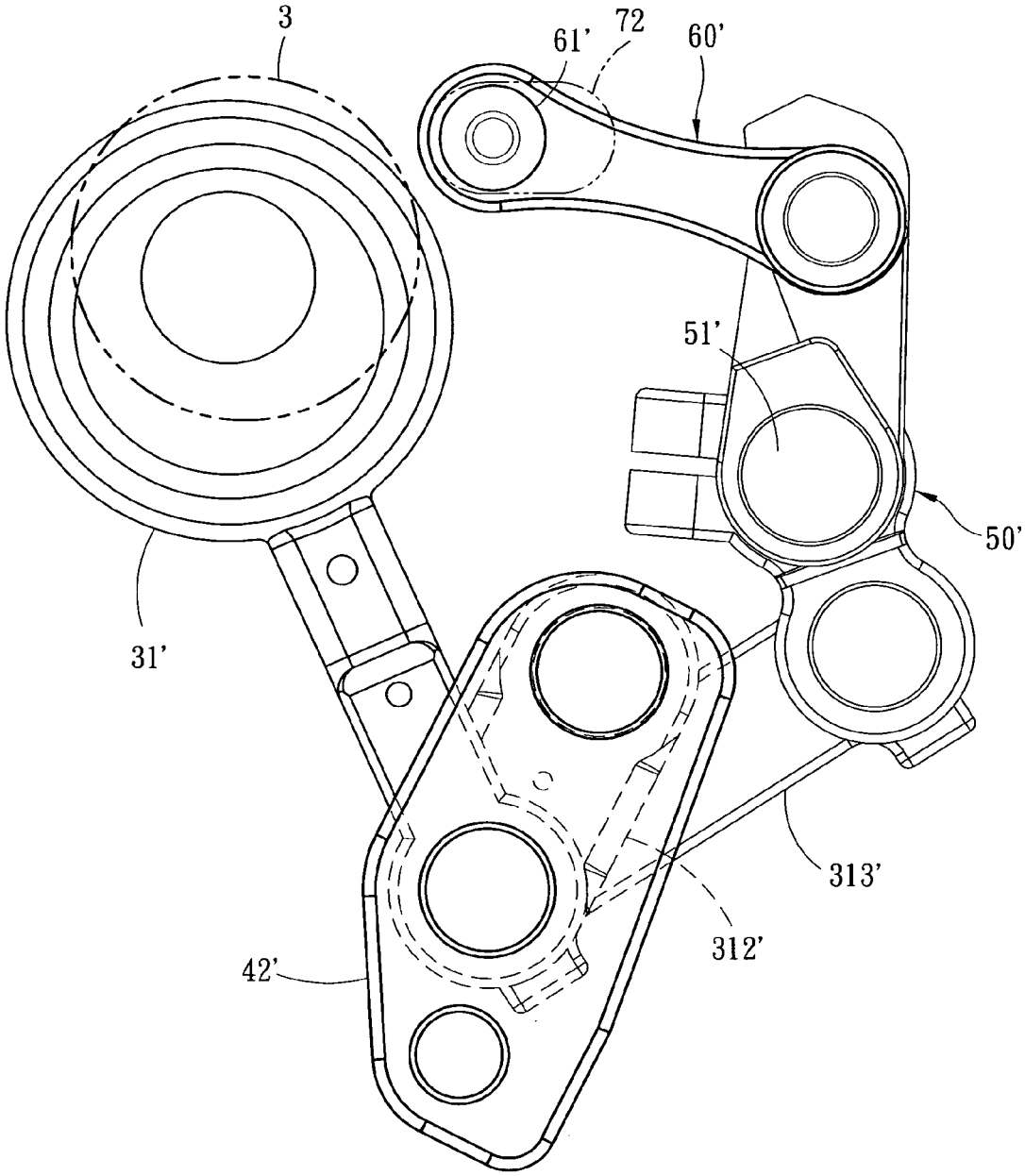

Refer to FIG. 3A, FIG. 3B and FIG. 3C diagrams showing the operations of the translation gears. The operation modes of the front and rear translation gears 71, 81 are similar and are to be exemplified with the rear translation gear 81. The central axis of the main shaft 3 is fixed, and the main shaft 3 rotates around the central axis thereof to drive the swing unit 30. When the adjust units 40, 40' are set at some position, the swing unit 30 will swing up and down owing to the first and second eccentric sleeves 11, 12 coupled to the front rocking shaft 10, which enables the transmission shafts 51, 51' of the transmission arm units 50, 50' to drive the front and rear translation blocks 70, 80 to create the to-and-fro actions of the front and rear translation blocks 70, 80.

Figure 3D:
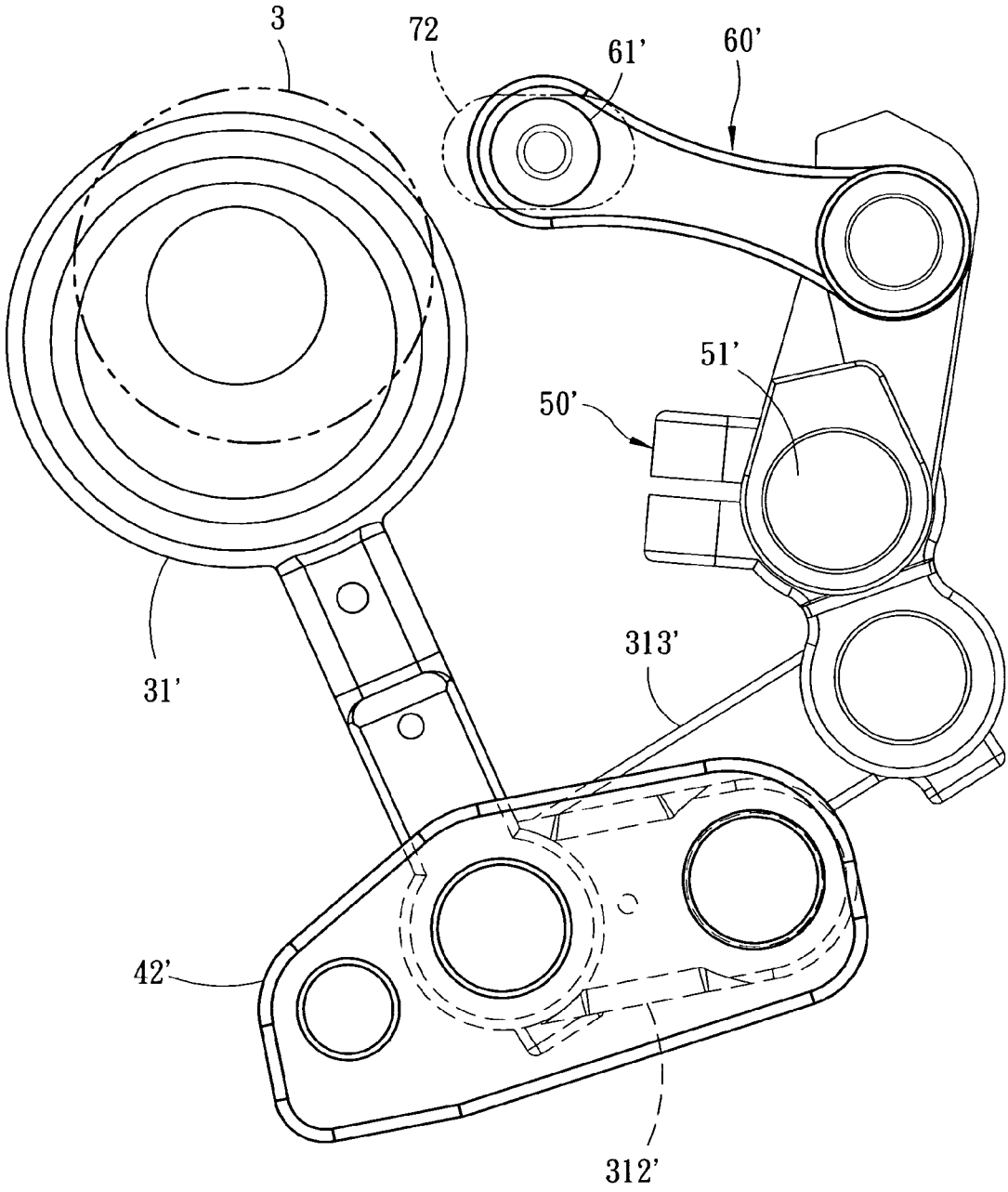
FIG. 3D and FIG. 3E are schematic diagrams showing other operations of one embodiment of the present invention.
Figure 3E:
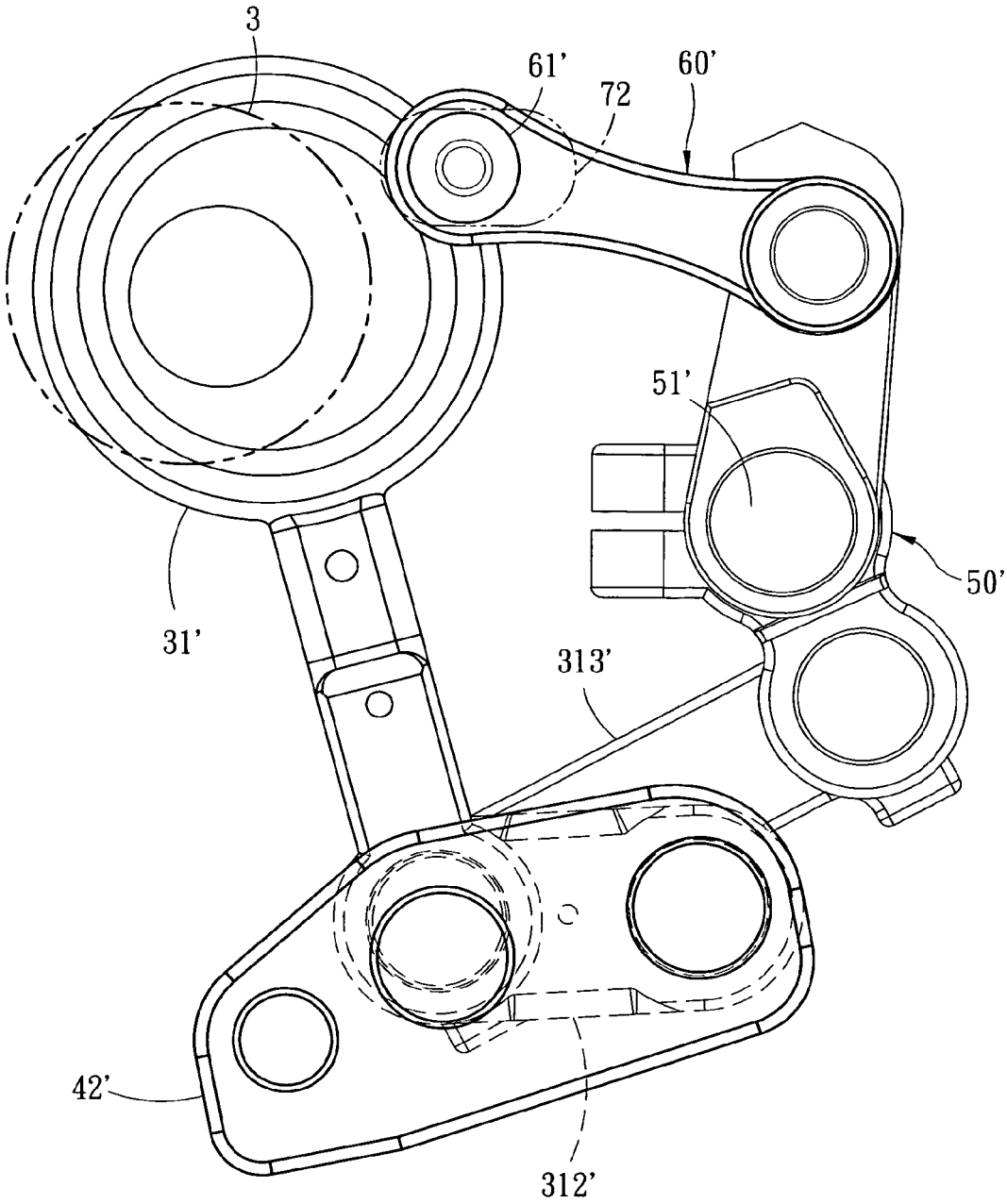

Refer to FIG. 3D and FIG. 3E diagrams showing the operations of the translation gears. The operation modes of the front and rear translation gears 71, 81 are similar and are to be exemplified with the rear translation gear 81. When the adjust units 40, 40' are set at another position, the shift elements 43, 43' move the counter balance weights 42, 42' and the corresponding second connecting levels 313, 313' and transmission arm units 50, 50' in order to increase or decrease the rotation radii of the transmission shafts 51, 51', which further increase or decrease the travel ranges of the planar to-and-fro translation of the displacement arm units 60, 60' inside the position-limiting holes 72, 82. Therefore, according to the pitch of the sewing thread, the travel ranges of the planar to-and-fro translation feeding of the front and rear translation gears 71, 81 can be adjusted by shifting the shift elements 43, 43' to some position of the scale elements 44, 44'.

Figure 4A:
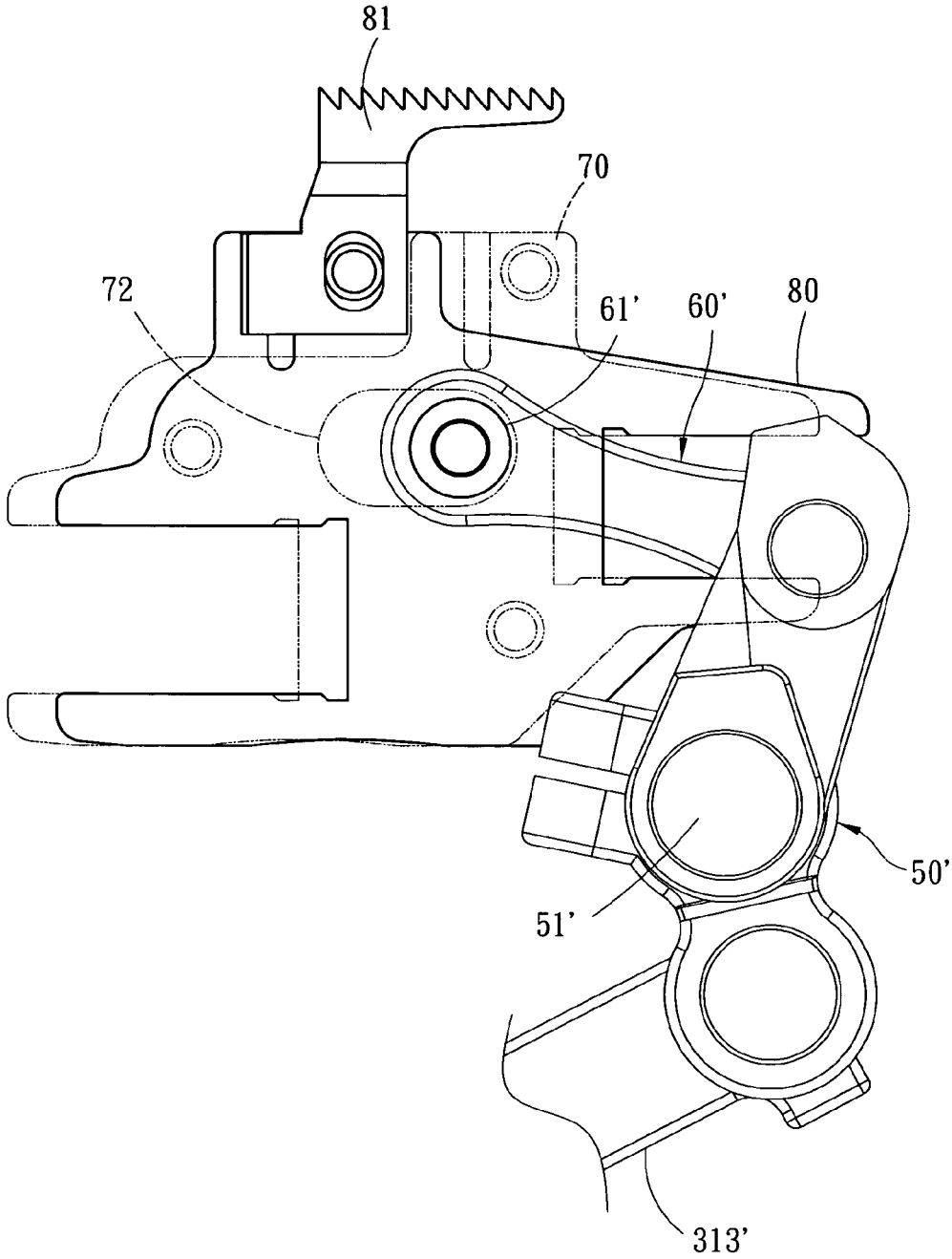
FIG. 4A and FIG. 4B are schematic diagrams of portions of one embodiment of the present invention.
Figure 4B:
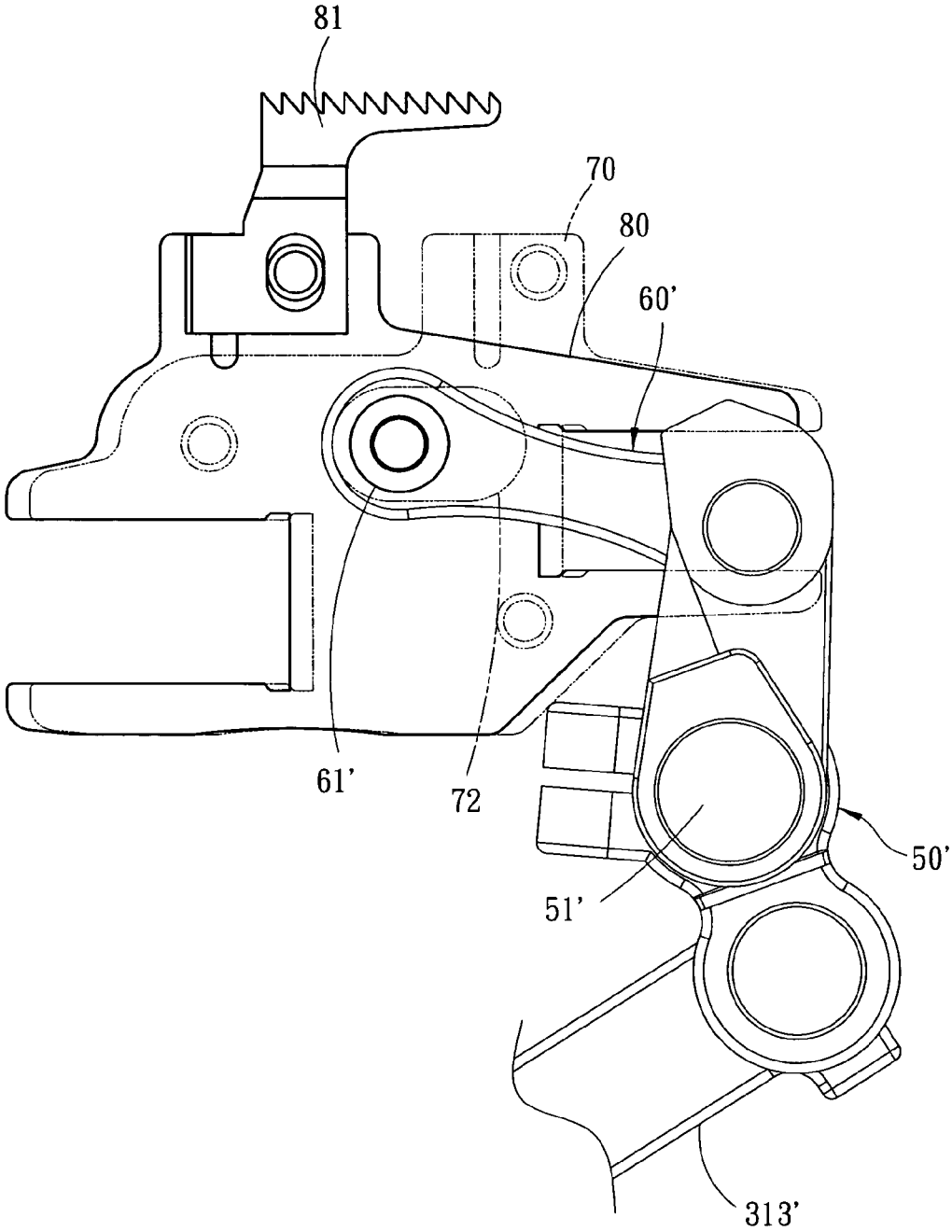
Figure 5A:
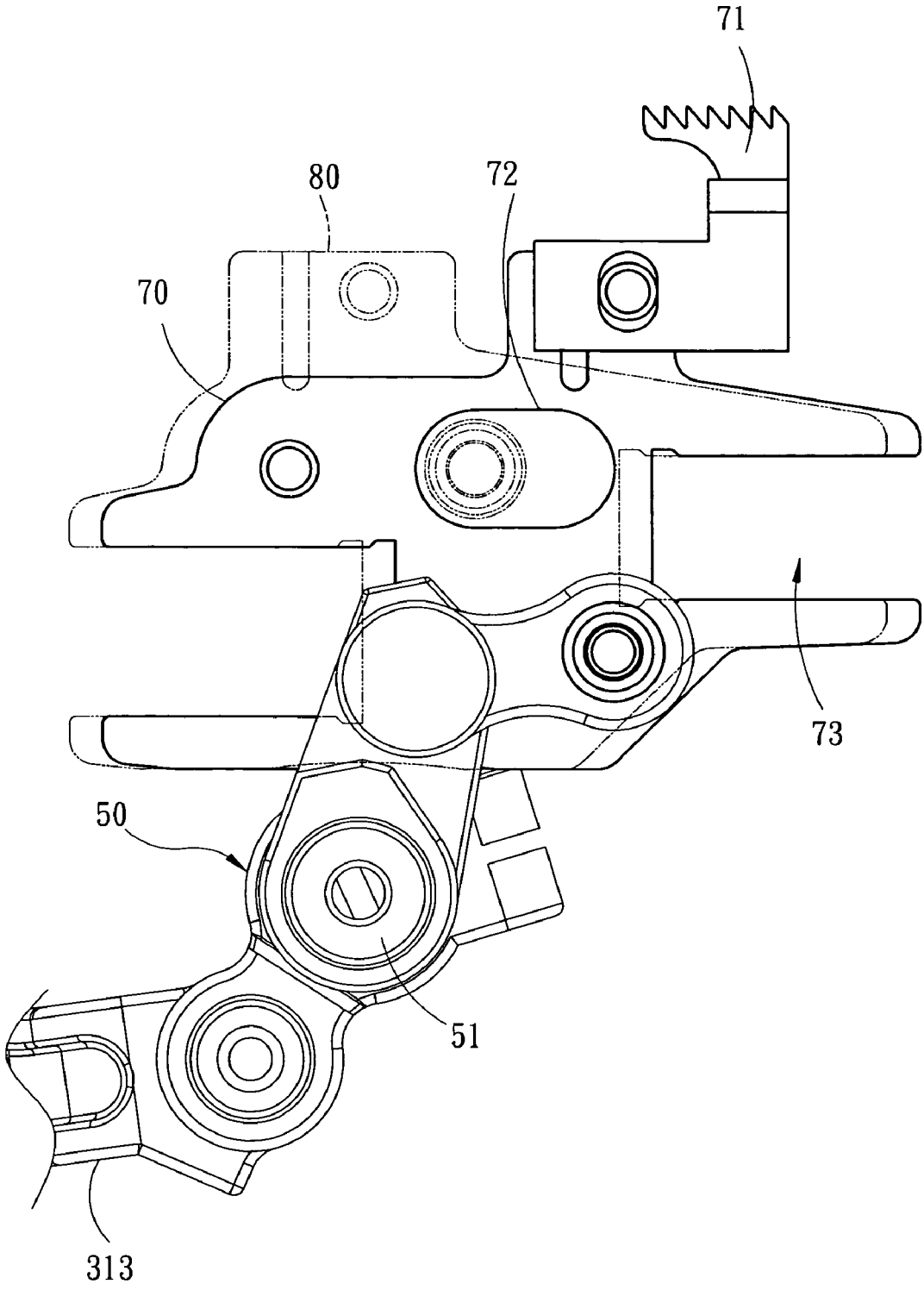
FIG. 5A and FIG. 5B are schematic diagrams of other portions of one embodiment of the present invention.
Figure 5B:
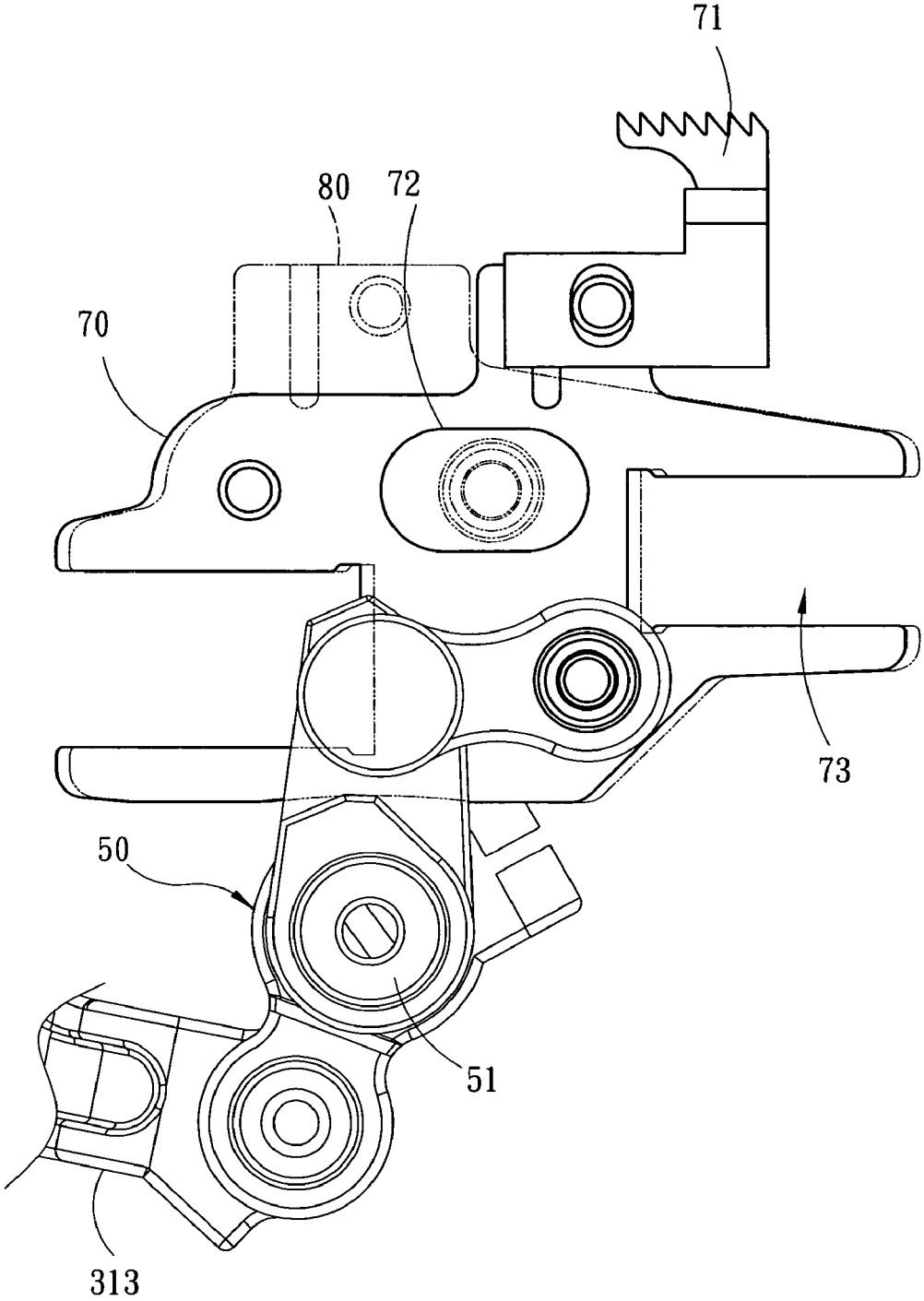

Refer to FIG. 4A, FIG. 4B, FIG. 5A and FIG. 5B diagrams showing the operations of the front and rear translation gears 71, 81. The up-and-down swing of the front rocking shaft 10 is enabled via engaging the convex portions 13 to the concave portion 73 of the front translation block 70, which further enables the up-and-down swing of the front translation gear 71. The link arm 14 coupled to the front rocking shaft 10 and the crank 15 coupled to the link arm 14 enable the rear rocking shaft 20 to swing up and down, which further enables the up-and-down swing of the rear translation gear 81 via engaging the convex portions 21 to the concave portion 83 of the front translation block 80. The feedings of the planar to-and-fro translations of the front and rear translation gears 71, 81 are enabled via the swing unit 30, the transmission arm units 50, 50' coupled to the swing unit 30, the displacement arm units 60, 60' coupled to the transmission arm units 50, 50', and the front and rear translation blocks 70, 80 driven to move to and fro by the displacement arm units 60, 60'. As shown in FIG. 4A and FIG. 4B, the positioning elements 61' of the displacement arm unit 60' is inserted into the position-limiting hole 72 of the front translation block 70 and assembled to the position-limiting hole 82 of the rear translation block 80; thus, the displacement of the positioning elements 61' enable the displacement of the rear translation block 80, which further enable the planar to-and-fro translation of the rear translation gear 81 because the rear translation gear 81 is fixed to the rear translation block 80; further, the travel range of the positioning elements 61' inside the position-limiting hole 72 can be increased or decreased by the adjust unit 40'. As shown in FIG. 5A and FIG. 5B, the positioning elements 61 of the displacement arm unit 60 is inserted into the position-limiting hole 82 of the front translation block 80, thus, the displacement of the positioning elements 61 enable the displacement of the front translation block 70, which further enable the planar to-and-fro translation of the front translation gear 71 because the front translation gear 71 is fixed to the front translation block 70; further, the travel ranges of the positioning elements 61 and the front translation gear 71 can be increased or decreased by the adjust unit 40.

Figure 6:
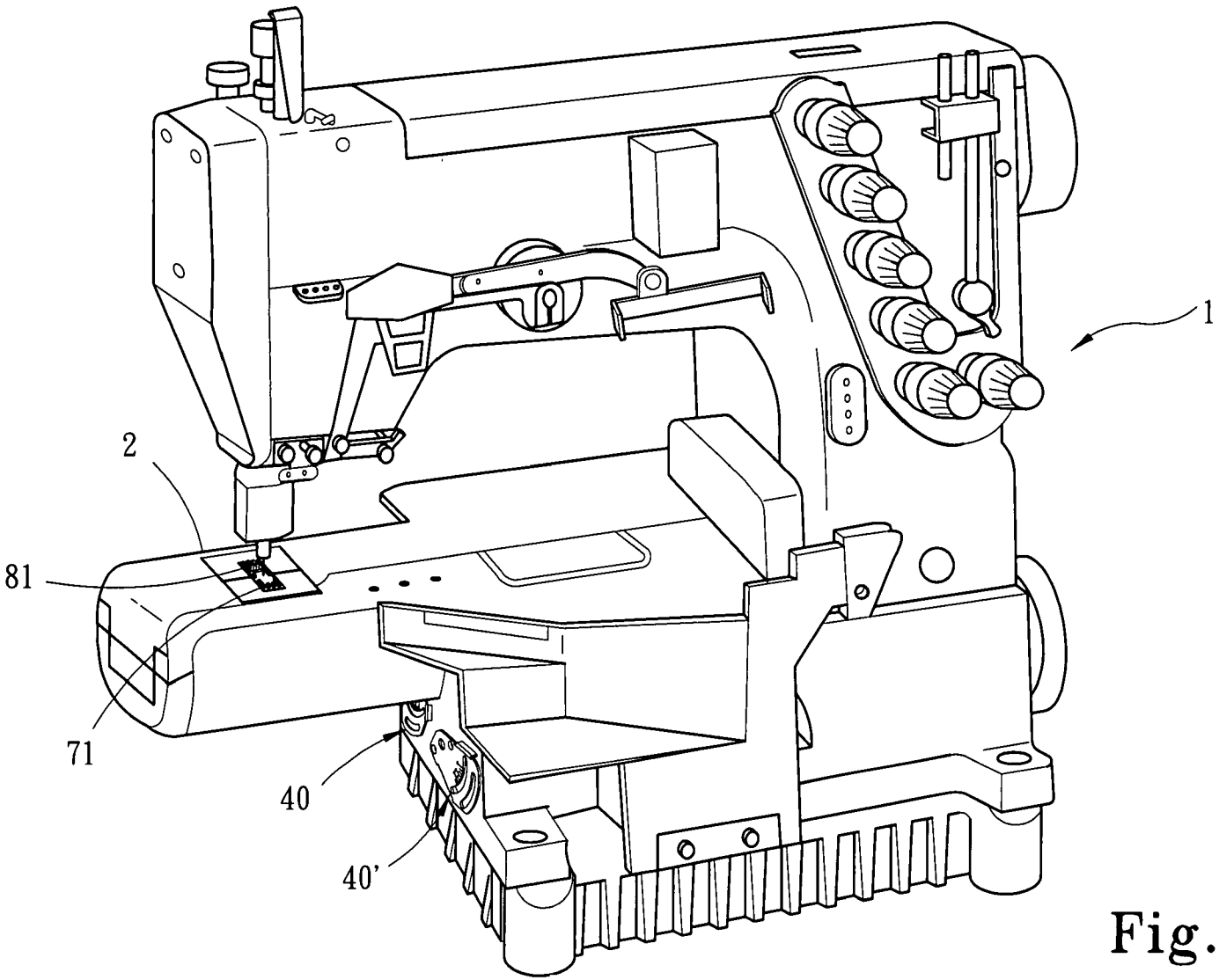
FIG. 6 is a schematic diagram of one embodiment of the present invention.

Refer to FIG. 6 a diagram of an embodiment of the present invention. The above mentioned differential feeding mechanism 2 of the front and rear translation gears of a transverse shuttle-type sewing machine 1 is installed in the fabric-feeding portion of a transverse shuttle-type sewing machine 1. The shift elements 43, 43' of the adjust units 40, 40' are installed on the housing of the transverse shuttle-type sewing machine 1. According to demand, the user can shift the shift elements 43, 43' to adjust the ranges of the planar feeding travel of the front and rear translation gears 71, 81 in order to create sewing threads of different pitches or a wrinkle effect.

In summary, in the present invention, the rotation of the main shaft 3 drives the front rocking shaft 10 to rotate eccentrically, which further eccentrically drives the link arm 14, and the link arm 14 enables the rear rocking shaft 20 to swing to and fro, which enables the front and rear translation gears 71, 81 to move up and down. The rotation of the main shaft 3 also separately drives the front and rear swing arms 31, 31' in an eccentric way, which further separately drives the transmission shafts 51, 51' to swing to and fro, and the transmission shafts 51, 51' further separately enable the front and rear translation gears 71, 81 to move to and fro transversely. It is to be noted: No matter whether the front and rear translation gears 71', 81 are enabled to move vertically and transversely via being driven by the eccentric rotation of the front rocking shaft 10, the to-and-fro swing of the rear rocking shaft 20, or the to-and-fro swing of two transmission shafts 51, 51', all of them are driven by the main shaft 3 via transmission or linking-up mechanisms, and in the present invention, the adjust units 40, 40' are separately installed in the action paths of the transmission shafts 51, 51' in order to control the transverse travel ranges of the front and rear translation gears 71, 81 operatively associated with the transmission shafts 51, 51'. Thus, the pitch of the sewing thread and the differential ratio of the front and rear translation gears 71, 81 can be adjusted according the user's demand.

Those described above are only the preferred embodiments of the present invention but not intended to limit the scope of the present invention. Any equivalent modification and variation according to the spirit of the present invention is to be included within the scope of the claims of the present invention.

What is claimed is:

1. A differential feeding mechanism of the front and rear translation gears of a transverse shuttle-type sewing machine, which is used to adjust the fabric feeding speeds of a front and a rear translation gears, comprising:

a main shaft, coupled to the power source of said sewing machine;

two rocking shafts, parallel to but not coaxial with said main shaft, and driven by said main shaft to swing up and down, wherein corresponding to said front translation gear, one of said two rocking shafts acts as a front rocking shaft, and corresponding to said rear translation gear, the other one of said two rocking shafts acts as a rear rocking shaft;

a swing unit, separately pivotedly coupled to said front rocking shaft and said rear rocking shaft, and further comprising a front swing arm and a rear swing arm, which separately control the feeding travel ranges of corresponding said front and rear translation gears; and two adjust units, further comprising two counter balance weights pivotedly coupled to said front swing arm and said rear swing arm and two shift elements fixedly coupled to said counter balance weights, and separately used to adjust the ranges of the planar to-and-fro feeding travels of said front and rear translation gears.

2. The differential feeding mechanism of the front and rear translation gears of a transverse shuttle-type sewing machine according to claim 1, wherein via shafts, the other ends of said front and rear swing arms are separately pivotedly coupled to the ends of first connecting levels and second connecting levels; the other ends of said second connecting levels are separately pivotedly coupled to the ends of transmission shafts of transmission arm units; and separately via displacement arm units, the other ends of said transmission shafts are operatively associated with corresponding said front and rear translation gears.

3. The differential feeding mechanism of the front and rear translation gears of a transverse shuttle-type sewing machine according to claim 2, wherein one of said counter balance weights, which is coupled to the other end of said first connecting levels pivotedly coupled to said front swing arm, acts as said adjust unit for said front translation gear; and the other one of said counter balance weights, which is coupled to the other end of said first connecting levels pivotedly coupled to said rear swing arm, acts as said adjust unit for said rear translation gear.

4. The differential feeding mechanism of the front and rear translation gears of a transverse shuttle-type sewing machine according to claim 2, wherein said two adjust units further comprise said counter balance weights having shafts with the ends of said shafts fixedly inserted inside said counter balance weights, and the other ends of said shafts are pivotedly coupled to said first connecting levels pivotedly coupled to said front and rear swing arms; and knobs are fixedly installed to the other ends of said counter balance weights, and said knobs further fixedly to said shift elements for shifting the positions of said counter balance weights.

5. The differential feeding mechanism of the front and rear translation gears of a transverse shuttle-type sewing machine according to claim 4, wherein said two adjust units further separately comprise scale elements, which are installed to the other ends of said shift elements and used to indicate the ranges of the planar translation of the to-and-fro feeding travels of corresponding said front and rear translation gears.

6. The differential feeding mechanism of the front and rear translation gears of a transverse shuttle-type sewing machine according to claim 1, wherein said two shift elements are disposed outside the housings of said transverse shuttle-type sewing machine in order to separately and instantly adjust the ranges of the planar translation of the to-and-fro feeding travels of corresponding said front and rear translation gears.

* * * * *